US007438531B2

(12) United States Patent
Chen et al.

(10) Patent No.: US 7,438,531 B2
(45) Date of Patent: Oct. 21, 2008

(54) FAN AND ROTOR STRUCTURE THEREOF

(75) Inventors: Ying-Chi Chen, Taoyuan Hsien (TW); Te-Tsai Chuang, Taoyuan Hsien (TW); Ming-Shi Tsai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 179 days.

(21) Appl. No.: 10/992,203

(22) Filed: Nov. 19, 2004

(65) Prior Publication Data

US 2005/0111985 A1 May 26, 2005

(30) Foreign Application Priority Data

Nov. 20, 2003 (TW) ..... 92132496 A

(51) Int. Cl.
*F04D 29/34* (2006.01)

(52) U.S. Cl. ..... 416/209; 416/244 R

(58) Field of Classification Search ..... 416/244 R, 416/246, 209, 174, 245; 415/174.3, 174.2, 415/229, 230

See application file for complete search history.

(56) References Cited

U.S. PATENT DOCUMENTS

| | | | | |
|---|---|---|---|---|
| 3,303,889 | A * | 2/1967 | Bates | 416/239 |
| 3,376,057 | A * | 4/1968 | Van Buren, Jr. | 403/197 |
| 3,663,389 | A * | 5/1972 | Koral et al. | 204/496 |
| 3,771,927 | A * | 11/1973 | Schiller | 415/131 |
| 4,012,171 | A * | 3/1977 | Suvak | 416/207 |
| 5,245,236 | A * | 9/1993 | Horng | 310/67 R |
| 5,267,842 | A | 12/1993 | Harmsen et al. | |
| 5,503,521 | A * | 4/1996 | Capon | 415/121.1 |
| 6,384,494 | B1 * | 5/2002 | Avidano et al. | 310/58 |
| 6,926,497 | B2 * | 8/2005 | Lin et al. | 415/213.1 |

FOREIGN PATENT DOCUMENTS

| | | |
|---|---|---|
| DE | 100 58 935 A1 | 6/2001 |
| DE | 101 09 299 A1 | 9/2001 |
| JP | 2000-97194 A | 4/2000 |
| JP | 2003-139156 A | 5/2003 |
| JP | 2003-528268 A | 9/2003 |
| WO | WO-01/71196 A1 | 9/2001 |

* cited by examiner

*Primary Examiner*—Edward Look
*Assistant Examiner*—Dwayne J White
(74) *Attorney, Agent, or Firm*—Birch, Stewart, Kolasch & Birch, LLP

(57) ABSTRACT

A fan and a rotor structure thereof. The rotor structure has a case, an upper linking structure, a lower structure, and a rotating shaft. The case has an opening at the axle center. The upper linking structure has a fixing portion and a threaded portion. The minimum radius of the fixing portion is longer than the radius of the opening. The threaded portion is disposed in the opening. The lower linking structure has a thread corresponding to the threaded portion. The upper linking structure and the lower linking structure is screwed together to secure the case therebetween. The rotating shaft is fixed in the upper linking structure or the lower linking structure.

20 Claims, 4 Drawing Sheets

FAN AND ROTOR STRUCTURE THEREOF

BACKGROUND OF THE INVENTION

1. Field of the Invention

The present invention relates to a fan and the rotor structure thereof.

2. Description of the Prior Art

Generally, in a conventional fan, the shaft and the case of the rotor structure are engaged by interference fit. In a large fan with significant size and weight, however, the shaft and the case may separate in operation due to the weight of the rotor structure. Typically, a rivet joint is used for large fans to engage the shaft and the case. With a rivet joint, the contact area of the shaft and the case increases to support the increased weight of the rotor structure.

FIG. 1 illustrates a rotor structure 100 in a conventional large-scale fan. The rotor structure 100 has a case 102, a fan blade 104, a copper sheath 106, and a shaft 108. The shaft 108 is disposed in the copper sheath 106 by interference fit, and the copper sheath 106 is riveted to the case 102 by the rivet joint 110. Further, an electrocoating layer is coated on the case 102.

In the conventional rotor structure 100, however, the copper sheath 106 is riveted to the case 102 by compression, so that the shock resistance of the rotor structure is limited. When the weight of the rotor structure increases, it is possible that the rivet joint 110 will fracture or separate due to the weight thereof, and the shaft 108 and the case 102 may separate.

Further, the copper sheath 106 is riveted to the case 102 by compression, so a portion of the electrocoating layer on the case 102 is scraped by the copper sheath 106. Thus, due to degradation of the electrocoating layer, the case 102 and the copper sheath 106 are exposed and may rust. In addition, a gap exists between the case 102 and the copper sheath 106 due to the rivet joint 110. Further, the shaft 108 is disposed in the copper sheath 106 by interference fit, such that a portion of the shaft 108 is exposed and may rust. In either case, the rotor structure and other elements in the fan may be damaged.

SUMMARY OF THE INVENTION

Accordingly, the invention provides a rotor structure to increase anti-rust properties thereof and to extend the fan life. The present invention also provides a rotor structure having improved pressurization. A fan with a rotor structure with extended life can be obtained.

A rotor structure is disclosed. The rotor structure comprises a case, an upper linking structure, a lower linking structure, and a rotating shaft. The case comprises an opening at the axle center. The upper linking structure comprises a fixing portion and a threaded portion. The minimum radius of the fixing portion is longer than the radius of the opening. The threaded portion is disposed in the opening. The lower linking structure has a thread corresponding to the threaded portion. The upper linking structure and the lower linking structure are screwed together to secure the case therebetween. The rotating shaft is fixed in the upper linking structure or the lower linking structure.

In a further embodiment, a rotor structure is disclosed, which comprises a securing structure and a rotating shaft. The securing structure is screwed or wedged in a case, and the rotating shaft is fixed to the securing structure. The securing structure comprises an upper linking structure and a lower linking structure. The upper linking structure comprises a fixing portion and a threaded portion. The minimum radius of the fixing portion is longer than the maximum radius of the threaded portion. The lower linking structure comprises a thread corresponding to the threaded portion. The upper linking structure and the lower linking structure is screwed together to secure the case therebetween. The rotor structure can be applied to a fan.

In the rotor structure, the case and the rotating shaft can be combined by at least one securing structure. Thus, combination and the airtight connection between the case, the rotating shaft and the securing structure are increased. Additionally, the manufacturing process of the rotor structure is simplified, and the manufacturing period of the rotor structure is decreased.

Further, the rotor structure of the present invention comprises waterproof structure, so the rotor structure can prevent the inner components of the fan from rust.

A sealing can be formed between the securing structure and the case to provide the airtight connection for preventing.

Further, an electrocoating coating process to form an electrocoating layer can be performed after assembly of the rotor structure so that the electrocoating layer is not damaged. The electrocoating layer can cover the clearance in the connection area and to prevent the inner component of the fan from rust.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION OF THE PREFERRED EMBODIMENTS

Figure 1:
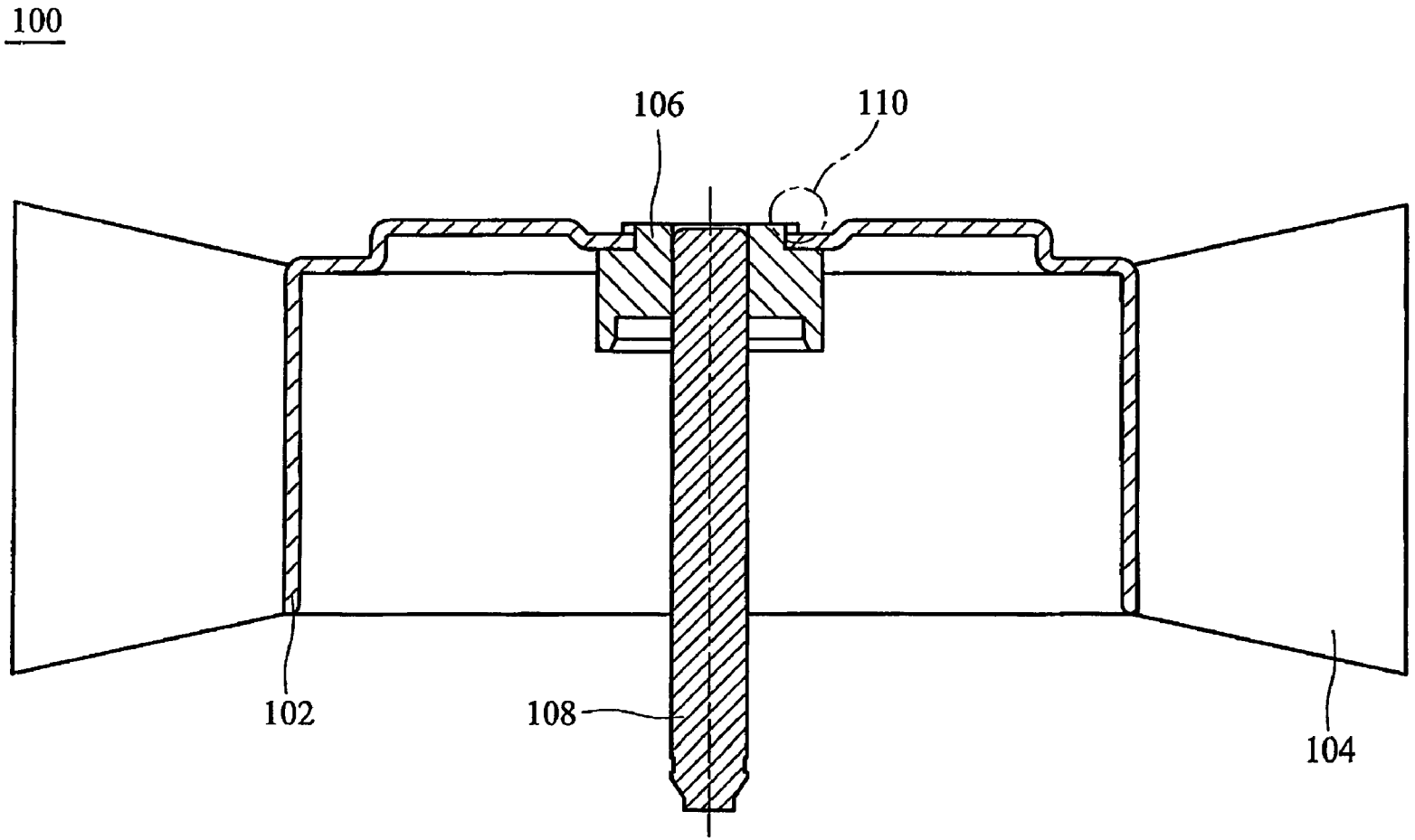
FIG. 1 ( RELATED ART )
FIG. 1 is a schematic view of the conventional rotor structure.
Figure 2:
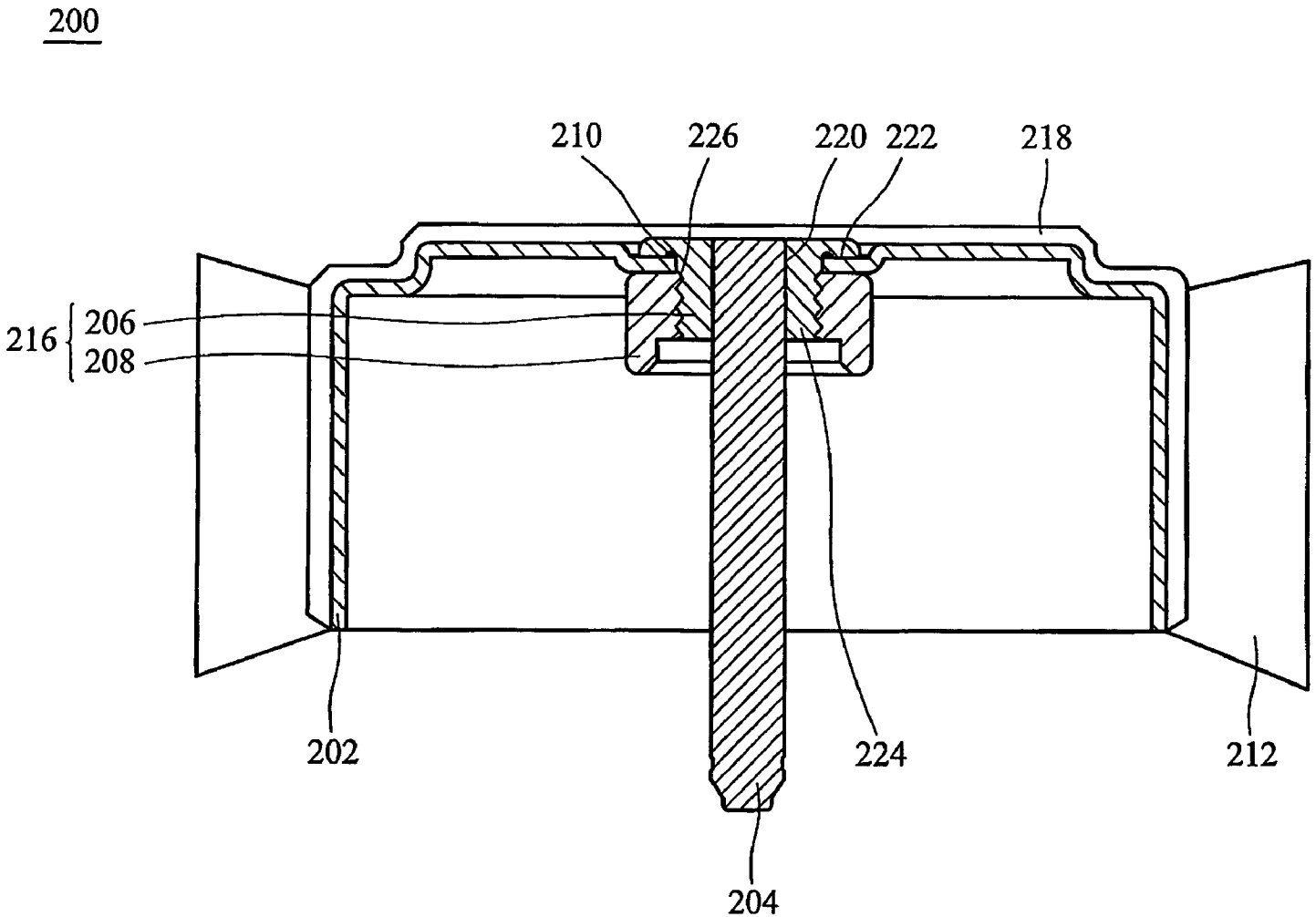
FIG. 2 is a schematic view of a rotor structure of an embodiment of the invention.
Figure 3:
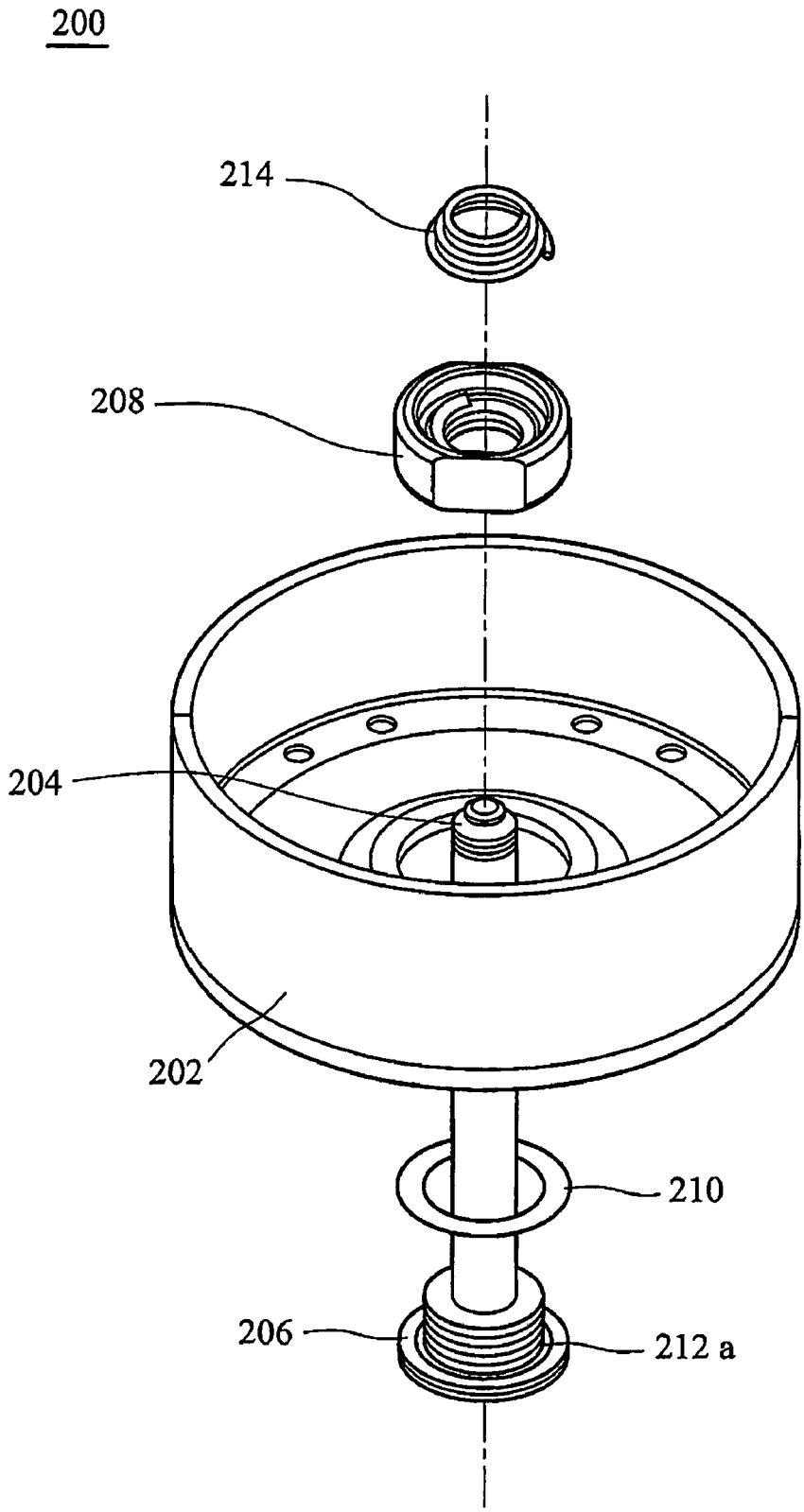
FIG. 3 is a partial exploded view of the rotor structure of an embodiment of the invention.

FIG. 2 shows an embodiment of a rotor structure 200. FIG. 3 is a partial exploded view of the rotor structure 200 in FIG. 2.

The rotor structure 200 comprises a case 202, a securing structure 216, and a rotating shaft 204 fixed to the case 202 by the securing structure 216.

The case 202 is the body of the rotor structure 200 and has a tubular shape. An opening 226 is disposed in an axle center on the bottom of the case 202 to enclose the securing structure 216. Specifically, a cross-section of the tubular shape can be circular, polygonal, or other similar shapes, and the opening 226 can be circular, polygonal, regular-patterned or irregular-patterned. The case 202 can be fabricated by punching or integral forming, and the material of the case 202 is metal, plastic or alloy.

When the rotor structure 200 is applied to a fan or other similar device, a fan blade 212 can be disposed surrounding periphery of the case 202. The fan blade 212 can be an axial-flow fan blade, a centrifugal fan blade, a flat fan blade, or a blower fan blade. The material of the fan blade 212 is metal, plastic or alloy.

Figure 4:
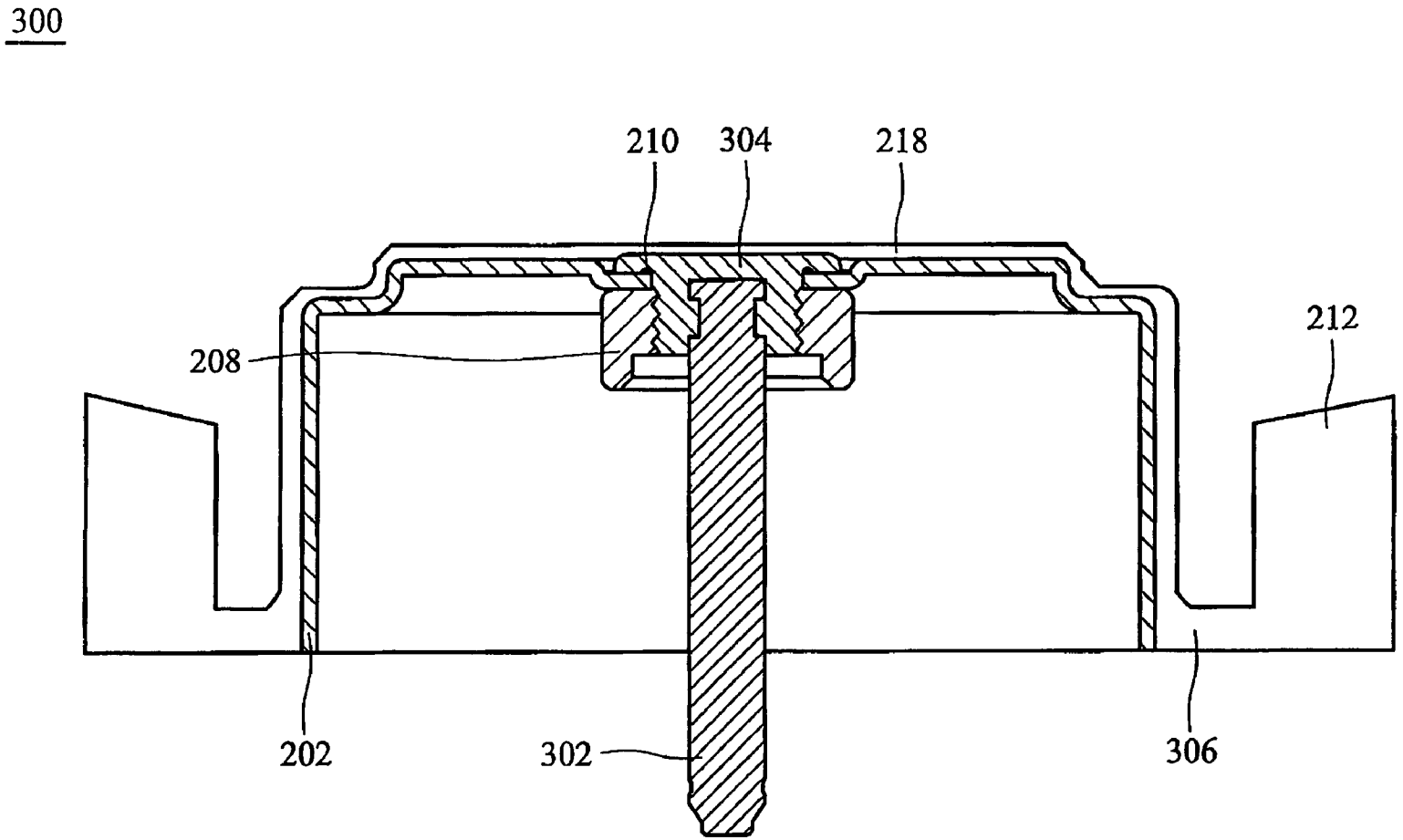
FIG. 4 is a schematic view of another rotor structure of an embodiment of the invention.

FIG. 4 shows another embodiment of the rotor structure 300. In FIG. 4, a protection housing 218 is connected to the fan blade 212 via a connecting portion 306 to cover and protect the uncovered surface of the case 202. The protection housing 218 is of plastic, metal or alloy. The protection housing 218, the connecting portion 306 and the fan blade 212 can be connected by integral forming, adhesive bonding, hooking or engaging.

The securing structure 216 can comprise a single linking structure 206. The linking structure 206 comprises a threaded portion 224 and a fixing portion 222. A maximum radius of the threaded portion 224 is shorter than a minimum radius of the fixing portion 222. Further, the maximum radius of the threaded portion 224 is slightly shorter than or equal to a radius of the opening 226, and the minimum radius of the fixing portion 222 is longer than the radius of the opening 226. In this case, when threads of the opening 226 correspond to the threaded portion 224, the threaded portion 224 is screwed into the opening 226 to fix to the case 202. It is preferable that a screwing direction between the threaded portion 224 and the opening 226 is opposite to a rotating direction of the rotor structure 200. Thus, the securing structure 216 does not loose when the rotor structure 200 is in operation.

In FIG. 2 and FIG. 4, the securing structure 216 can comprise two linking structures 206 and 208. The linking structure 206 is screwed into the opening of the linking structure 208 to secure the case 202 between the linking structures 206 and 208. The linking structure 208 has inner threads corresponding to the threaded portion 224, and the maximum radius of the linking structure 208 is longer than the radius of the opening 226. If that a screwing direction of the linking structure 208 and the threaded portion 224 is opposite to a rotating direction of the rotor structure 200, the linking structure 206 does not loose from the linking structure 208 when the rotor structure 200 is in operation. The opening 226 is provided either with or without the threads.

Further, the threaded portion 224 of the linking structure 206 can be inner threads, and the linking structure 208 has an outer threads corresponding to the inner threads. The rotating shaft 204 is connected to the linking structure 208 by embedding, dying or engaging. Specifically, the linking structures 206 and 208 can be a set of screw and nut.

A hole 220 is disposed in the axle center of the linking structure 206 for fixing the rotating shaft 204. The hole 220 can be either a through hole as shown in FIG. 2, or a blind via as shown in FIG. 4. In FIG. 2, the rotating shaft 204 passes throughout the linking structure 206 and is exposed. In FIG. 4, the rotating shaft 302 is embedded and protected in the linking structure 304. The shape of the opening 220 is corresponding to that of the rotating shaft 302.

A buffer structure 214 is provided in the rotor structure 200, connected to the securing structure 216. Specifically, the opening of the linking structure 208 comprises two ends, with a radius of the end near the fixing portion 222 shorter than a radius of the end away from the fixing portion 222. Thus, a space is formed at the bottom of the linking structure 208 for securing the buffer structure 214. The outer periphery of the linking structures 206, 208 or 216 can be a circle, polygon, polyhedron, ellipse, or a sliced circle. The buffer structure 214 connects the housing to the stator structure or the rotating shaft protection structure seamlessly. The buffer structure 214 can be a spring or an elastic member.

An sealing 210 can be disposed between the linking structure 206 and the case 202 by integral forming or direct forming. The sealing 210 can be an oil ring, a silicon spacer, an elastic pad, a seal, or a rubber sealing. When the sealing 210 is directly formed between the linking structure 206 and the case 202, an indentation 212*a* is formed on the linking structure 206 and the case 202 to fill in the sealing 210. The indentation 212*a* can be formed on the linking structure 206 or the case 202 or both. Further, the sealing 210 can be circular, ring-shaped, star-shaped, polygonal, or an enclosed shape. It is applicable to form a plurality of individual sealings to secure the airtight connection. The sealings are disposed separately or crossing with each other.

In FIG. 2 and FIG. 4, the rotating shaft 204 or 302 is fixed to the linking structure 206 or 304. The fixing portion of the rotating shaft can be a cylinder, a column with embossing sides, or a wedge. In either case, the shape of the hole 220 corresponds to the fixing portion of the rotating shaft 204, 302. The rotating shaft can be fixed by embedding, dying or wedging.

In assembly of the rotor structure 200, an electrocoating layer is coated on the rotor structure 200 to prevent from rust. Since the electrocoating layer is applied after assembly of the rotor structure 200, there is no need to perform a pre-coating process for the individual elements of the rotor structure. Thus, assembly of the rotor structure is simplified, and manufacturing time and cost are reduced.

In the rotor structure, the case and the rotating shaft can be combined by at least one linking structure. Thus, combination and the airtight connection between the case, the rotating shaft and the linking structure are increased. Additionally, the manufacturing process of the rotor structure is simplified, and the manufacturing period of the rotor structure is decreased.

Further, the rotor structure of the present invention comprises waterproof structure, so the rotor structure can prevent the inner components of the fan from rust.

A sealing can be formed between the linking structure and the case to provide the airtight connection for preventing.

Further, an electrocoating coating process to form an electrocoating layer can be performed after assembly of the rotor structure so that the electrocoating layer is not damaged. The electrocoating layer can cover the clearance in the connection area and to prevent the inner component of the fan from rust.

As well, the rotor structure of the invention can be employed in a fan or a motor. Because the rotating shaft is screwed to the housing, the lifetime of the fan or the motor can be extended by renewing the rotating shaft.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A rotor structure, comprising:

a case with an opening; and a securing structure screwed or wedged on the case and having a threaded portion and a fixing portion, wherein a maximum radius of the threaded portion is slightly shorter than or equal to a radius of the opening, and a minimum radius of the fixing portion is greater than the radius of the opening; and a rotating shaft fixed to the securing structure.

2. The rotor structure as claimed in claim 1, wherein the securing structure further comprises:

a first linking structure having the fixing portion and the threaded portion, a minimum radius of the fixing portion being longer than a maximum radius of the threaded portion; and a second linking structure having a thread corresponding to the threaded portion to screw the first linking structure and the second linking structure together to secure the case therebetween.

3. The rotor structure as claimed in claim 2, wherein the threaded portion has an inner thread, and the second linking structure has an outer thread corresponding to the inner thread.

4. The rotor structure as claimed in claim 2, wherein an outer wall of the securing structure is circular, polygonal, oval-shaped, or has at least one circular cross-section.

5. The rotor structure as claimed in claim 2, wherein the second linking structure has a hole, the threaded portion being screwed to the thread in the hole.

6. The rotor structure as claimed in claim 5, wherein the radius of one end of the second linking structure adjacent to the fixing portion is shorter than a radius of the other end of the second linking structure away from the fixing portion.

7. The rotor structure as claimed in claim 1, further comprising at least one sealing disposed between the securing structure and the case.

8. The rotor structure as claimed in claim 7, wherein the sealing is an oil ring, a silicon spacer, an elastic pad, a seal, or a rubber sealing.

9. The rotor structure as claimed in claim 7, further comprising at least one indentation to fill in the sealing, wherein the indentation is formed on the securing structure, the case, or on the securing structure and the case simultaneously.

10. The rotor structure as claimed in claim 1, further comprising a buffer structure connected to the securing structure.

11. The rotor structure as claimed in claim 1, wherein the buffer structure is an elastic structure.

12. The rotor structure as claimed in claim 1, further comprising an electrocoating layer on an outer periphery of the case.

13. The rotor structure as claimed in claim 1, further comprising at least one fan blade disposed surrounding the periphery of the case.

14. The rotor structure as claimed in claim 13, further comprising a protection housing between the case and the fan blade.

15. The rotor structure as claimed in claim 1, wherein the rotating shaft is fixed to the securing structure by embedding, dying or wedging.

16. A fan, comprising:

a rotor having a securing structure and a rotating shaft, the securing structure being screwed or wedge on a case, and the rotating shaft being fixed to the securing structure; and at least one fan blade disposed on the periphery of the case.

17. The fan as claimed in claim 16, wherein the securing structure comprises:

a first linking structure having a fixing portion and a threaded portion, a minimum radius of the fixing portion being longer than a maximum radius of the threaded portion; and a second linking structure having a thread corresponding to the threaded portion to screw the first linking structure and the second linking structure together to secure the case therebetween.

18. The fan as claimed in claim 16, further comprising a sealing disposed between the securing structure and the case.

19. The fan as claimed in claim 18, wherein the sealing is an oil ring, a silicon spacer, an elastic pad, a seal, or a rubber sealing.

20. The fan as claimed in claim 18, further comprising at least one indentation to fill in the sealing, wherein the indentation is formed on the securing structure, the case, or on the securing structure and the case simultaneously.

* * * * *